US008603352B1

(12) United States Patent
Zhang-Beglinger et al.

(10) Patent No.: US 8,603,352 B1
(45) Date of Patent: Dec. 10, 2013

(54) CHROME-FREE METHODS OF ETCHING ORGANIC POLYMERS

(71) Applicant: Rohm and Haas Electronic Materials LLC, Marlborough, MA (US)

(72) Inventors: Wan Zhang-Beglinger, Adligenswil (CH); Katharina Weitershaus, Kriens (CH); Andreas Scheybal, Zurich (CH); Christos Comninellis, Mex (CH)

(73) Assignee: Rohm and Haas Electroncis Materials LLC, Marlborough, MA (US)

( * ) Notice: Subject to any disclaimer, the term of this patent is extended or adjusted under 35 U.S.C. 154(b) by 0 days.

(21) Appl. No.: 13/659,937

(22) Filed: Oct. 25, 2012

(51) Int. Cl.

| | |
|---|---|
| ***B44C 1/22*** | (2006.01) |
| ***C03C 15/00*** | (2006.01) |
| ***C03C 25/68*** | (2006.01) |
| ***C23F 1/00*** | (2006.01) |

(52) U.S. Cl.
USPC ..... 216/83; 252/79.2

(58) Field of Classification Search
USPC ..... 216/83; 252/79.2
See application file for complete search history.

(56) References Cited

U.S. PATENT DOCUMENTS

| | | | | |
|---|---|---|---|---|
| 5,556,787 | A | 9/1996 | Miller | |
| 7,578,947 | B2 * | 8/2009 | Schildmann et al. | 216/83 |
| 2011/0140035 | A1 | 6/2011 | Schildmann et al. | |

OTHER PUBLICATIONS

Comninellis et al, "Electrochemical oxidation of Mn(II) to $MnO_4$ in the presence of Ag(I) Catalyst", Electrochimica Acta, 1991, pp. 1636-1365, vol. 36, No. 8.

Pinto, et al, "Electrolytically generated manganese(III) sulphate as a redox titrant: potentiometric determination of thiosemicarbazide, its metal complexes and thiosemicarbazones," Analyst, 1991, pp. 285-289, vol. 116.

Belcher et al, "Trivalent manganese as an oxidimetric reagent", Analytica Chimica Acta, 1952, pp. 322-332, vol. 6.

Comninellis, et al, "Current efficiency losses in indirect electrochemical processing", J. Electrochem. Soc., 1985, pp. 72-76, vol. 132, No. 1.

Cui, et al, "The role of manganese in model systems related to lignin biodegration," Department of Chemistry, University of British Columbia, 2036 Main Mall, Vancouver, BC., Canada.

Domini, et al, "Trivalent manganese as an environmentally friendly oxidizing reagent for microwave- and ultrasound-assisted chemical oxygen demand determination," Ultrasonics Sonochemistry, 2009, pp. 686-691, vol. 16.

Boardman, et al, The catalysis of the anodic oxidation of cobalt(II) and manganese(II) by silver(I) in aqueous sulphuric acid, J. Electroanal. Chem., 1983, pp. 49-56, vol. 149.

Fleischmann et al, "The kinetics of the silver (I)/silver (II) couple at a platinum electrode in perchloric and nitric acids," Journal of Applied Electrochemistry, 1971, pp. 1-7, vol. 1.

Comninellis et al, "Electrochemical production of manganic sulfate in concentrated $H_SSO_4$", J. Electrochem. Soc., 1982, pp. 749-752, vol. 129, No. 4.

Lee, et al, "Electrochemical oxidation of $Mn^{2+}$ on boron-doped diamond electrodes with $Bi^{3+}$ used as an electron transfer mediator", Journal of the Electrochemical Society, 2004, pp. E265-E270, vol. 151, No. 8.

* cited by examiner

*Primary Examiner* — Roberts Culbert
(74) *Attorney, Agent, or Firm* — John J. Piskorski

(57) ABSTRACT

A chrome-free composition of an acidic suspension of manganese compounds and manganese ions are applied to an organic polymer surface to etch the surface. The etched surface is then plated with metal.

10 Claims, 3 Drawing Sheets

CHROME-FREE METHODS OF ETCHING ORGANIC POLYMERS

FIELD OF THE INVENTION

The present invention is directed to chrome-free methods of etching organic polymers. More specifically, the present invention is directed to chrome-free methods of etching organic polymers using suspensions of manganese compounds.

BACKGROUND OF THE INVENTION

Prior to metallization a substrate surface containing organic polymers is typically etched to achieve good adhesion between the substrate surface and plated metals. Although great efforts have been made over the years by many chemical suppliers and the plating industry to replace currently used toxic etching solutions no commercial product which is free of hexavalent chromium or Cr(VI) is currently available on the market.

Cr(VI) containing compounds are suspected of being cancer-causing. Accordingly, dealing with these compounds is subject to strict environmental regulations. In the face of the potential danger caused by Cr(VI) releasing compounds, a prohibition of the industrial use of Cr(VI) containing compounds cannot be excluded.

Over the years a variety of chemical species have been suggested in the industry for use as chrome-free oxidizing agents in wet etching processes to modify organic polymer surfaces. Such oxidants include Mn(VII), Mn(VI), Mn(IV), Ce(IV), persulfate, $H_2O_2$, organic solvents such as dioxane, metal halogenides and nitrates of Fe, Cu, Ti, Zn, and Mg. Oxidizing agents are consumed either by the etching process or due to the instability of the oxidants. Therefore frequent replenishing or a re-generation method is needed. Re-generation methods are especially preferred for industrial settings. Mn(VII) is one of the most commonly used oxidizing agents. In solution it is typically in the form of ionic species $MnO_4^-$. Electrochemical regeneration of Mn(VII) in alkaline solutions has been used in different industries, such as in the manufacture of circuit boards. In acidic media re-generation of Mn(VII) appears more difficult than in an alkaline medium. Published literature using catalysts such as Ag(I) or Bi(III) for electrochemical oxidation is sparse. The studies of Fleischmann et al. (J. Appl. Electrochem. Vol. 1, pp. 1, 1971) have shown that Ag(I) is a good catalyst for oxidizing both organic and inorganic species electrochemically. Park et al. (J. Electrochem. Soc. Vol. 151, pp. E265, 2004) disclose that Bi(III) on a boron-doped diamond (BDD) electrode also may act as electron transfer mediator to oxidize Mn(II) to Mn(VII). Boardman (J. Electroanal. Chem. Vol. 149, pp. 49, 1983) and Comninellis (Electrochimica Acta, Vol. 36, No. 8, pp. 1363, 1991) have demonstrated the possibility of electrochemical formation of Mn(VII) from Mn(II) in a sulfuric acid medium in the presence of Ag(I) and the experimental conditions to increase the current efficiency of Mn(VII) formation. US2011/0140035 discloses similar methods for use in a permanganate acidic pickling solution for pre-treatment of plastic surfaces.

However, either in an acidic or alkaline medium, Mn(VII) is unstable and tends to reduce to its lower oxidation states, especially to Mn(IV), consequently forming a large quantity of the insoluble $MnO_2$ and causing quality issues on the treated polymer surfaces. Frequent removal of $MnO_2$ precipitation from the permanganate etching solution is therefore required in the industrial scale operation. Therefore, there is a need for a method which does not form substantial amounts of undesirable insoluble reaction products and the oxidizing agent can be re-generated during continuous operation.

SUMMARY OF THE INVENTION

Methods include providing a substrate including one or more organic polymers; providing a composition including a suspension of one or more undissolved Mn(II) compounds, or one or more undissolved Mn(III) compounds, or mixtures thereof, dissolved Mn(II) ions and dissolved Mn(III) ions, and one or more acids; and contacting the substrate including the one or more organic polymers with the composition to etch a surface of the substrate.

Compositions include suspensions of one or more undissolved Mn(II) compounds, or one or more undissoved Mn(III) compounds, or mixtures thereof, dissolved Mn(II) ions and dissolved Mn(III) ions, and one or more acids.

The methods and compositions etch the surface of substrates which include organic polymers prior to metallization using a chrome-free composition, thus eliminating a hazardous and an environmentally undesirable compound. The methods and compositions use dissolved Mn(III) ions as oxidizing agents in place of Cr(VI). Mn(III) ions are more stable in the composition than Mn(VII) ionic species, do not readily form insoluble $MnO_2$ as does Mn(VII), and Mn(III) ions reduced to Mn(II) ions, in the etching process, may be readily regenerated.

DETAILED DESCRIPTION OF THE INVENTION

Figure 1:
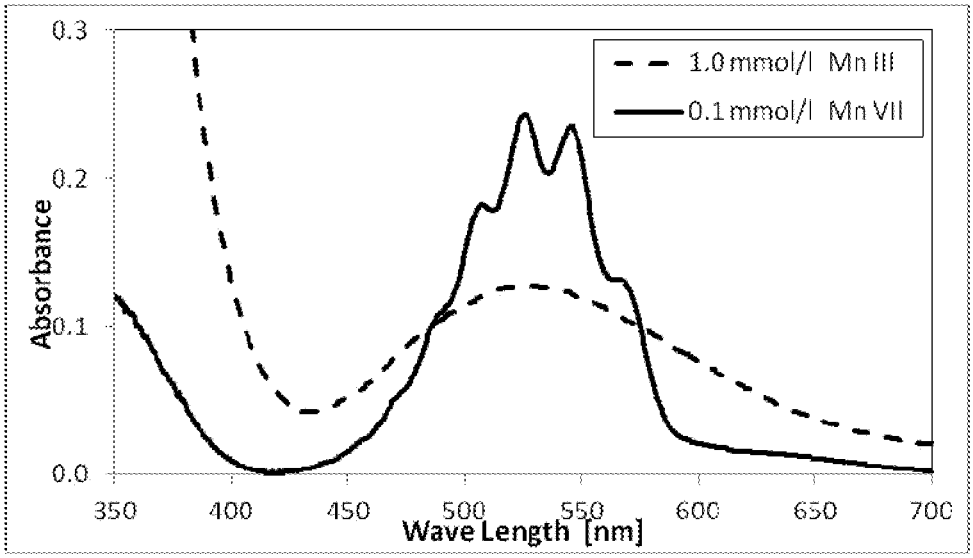
FIG. 1 is a UV-VIS spectrum as % absorbance vs. wave length in nm of a 1 mmol/L Mn(III) ions solution and a 0.1 mmol/L $KMnO_4$ solution.

As used throughout this specification, the abbreviations given below have the following meanings, unless the context clearly indicates otherwise: ° C.=degrees Centigrade; g=gram; L=liter; M=molar or moles/liter; mM=millimolar; mol=moles; mmol=millimoles; mL=milliliters; g/L=grams per liter; UV=ultra-violet; nm=nanometers; cm=centimeter; wt %=percent by weight; $T_g$=glass transition temperature; ASTM=American Standard Testing Method; Mn=elemental manganese; Mn(II)=manganese two oxidation state; Mn(III) =manganese three oxidation state; Mn(IV)=manganese four oxidation state; Mn(VI)=manganese six oxidation state; Mn(VII)=manganese seven oxidation state; Cr(VI)=chromium six oxidation state; Ag=silver; Bi=bismuth; Ce=cerium; Pb=lead; Ir=iridium; $H_2SO_4$=sulfuric acid; $MnO_4^-$=permanganate; $KMnO_4$=potassium permanganate; $Ag_2SO_4$=silver sulfate; $Ag_2O$=silver oxide; ozone=$O_3$; and $H_2O_2$=hydrogen peroxide.

All numerical ranges are inclusive and combinable in any order, except where it is logical that such numerical ranges are construed to add up to 100%. All amounts are percent by weight and all ratios are by weight, unless otherwise noted. The terms "a" and "an" are inclusive of both the singular and the plural.

Compositions include one or more undissolved Mn(II) compounds, or one or more undissolved Mn(III) compounds, or mixtures thereof, dissolved Mn(II) ions and dissolved Mn(III) ions, and one or more acids. Because the undissolved compounds are solid particles in a liquid phase, the composition is a suspension. Dissolved Mn (II) and Mn(III) ions are in equilibrium with their compounds in the solid phase. In the composition the active oxidizing agent is the dissolved Mn(III) ions. The suspended undissolved Mn(II) and Mn(III) species act as reservoirs for providing dissolved Mn(II) and Mn(III) ions. The concentrations of the ions are limited by their solubility at a given acid concentration and temperature. When dissolved Mn(III) ions or Mn(II) ions are consumed such as in an etching process, they are automatically replenished by dissolving Mn(III) from Mn(III) compounds in suspension form or by dissolving Mn(II) from Mn(II) compounds in suspension form. Therefore, the concentration of dissolved Mn(III) or Mn(II) ions is self-regulated as long as there is undissolved Mn(III) compounds or Mn(II) compounds in the suspension.

The presence of Mn(II) ions enables Mn(III) to be substantially the only Mn species in a higher oxidation state than Mn(II). In an acidic medium, if other Mn species having higher oxidation states than Mn(III) form in the composition, they are reduced to Mn(III) by the following redox reactions:

$$Mn(VII)+4Mn(II)\rightarrow 5Mn(III) \quad \text{eq.1}$$

$$Mn(VI)+3Mn(II)\rightarrow 4Mn(III) \quad \text{eq.2}$$

$$Mn(IV)+Mn(II)\rightarrow 2Mn(III) \quad \text{eq.3}$$

The pH of the etching compositions are from less than 1 to 6, preferably from less than 1 to 3, more preferably less than 1. In the presence of Mn(II) ions, the suspension is substantially free of Mn(VI), Mn(VII) and the insoluble $MnO_2$.

Preferably, the Mn(II), both as undissolved compounds and dissolved ions, are included in the compositions in amounts of 0.1 mmol/L and greater, more preferably the Mn(II) species are included in the compositions in amounts of 1 mmol/L and greater. Most preferably the Mn(II) species are included above their saturation concentration. The saturation concentration may vary depending on the temperature and acid content of the composition; however, formation of a precipitate is indicative of saturation of a species.

In general, the Mn(III), both as undissolved compounds and dissolved ions, are included in amounts of at least 0.01 mmol/L to etch organic polymers in preparation for metal plating; however, the amount may depend on the organic polymer or organic polymer composite of the substrate. Preferably the Mn(III) species ranges in amounts from 1 mmol/L to above the saturation concentration, more preferably from 5 mmol/L to above the saturation concentration. Most preferably the Mn(III) species may be included in the etching compositions in amounts above their saturation point.

Sources of Mn(III) in the suspensions, include, but are not limited to, Mn(III)-sulfate, Mn(III)-acetate, Mn(III)-acetylacetonate, Mn(III)-fluoride, Mn(III)-methanesulfonate, Mn(III)-oxide, Mn(III)-oxyhydroxide, Mn(III)-phosphate, Manganese(III) species with nitrogen-chelates such as porphines such as 5,10,15,20-tetraphenyl-21H,23H-porphine and 2,3,7,8,12,13,17,18-octaethyl-21H-23H-porphine and phthalocyanines. Such compounds are known in the art and literature and some are commercially available.

Sources of Mn(II) include, but are not limited to, Mn(II)-sulfate, Mn(II)-phosphate, Mn(II)-hydrogen phosphate, Mn(II)-hypophosphate, Mn(II)-carbonate, Mn(II)-oxide, Mn(II)-hydroxide, Mn(II)-halogenide, Mn(II)-nitrate, Mn(II)-acetate, Mn(II)-lactate, Mn(II)-oxalate, Mn(II)-citrate, Mn(II)-acetylacetonate, Mn(II)-sulfide, Mn(II)-formate, Mn(II)-ethylenediamine tetraacetate-complexes (EDTA), Mn(II)-nitrilo triacetic acid (NTA) complexes, manganese(II) species with nitrogen-chelates such as porphines such as 5,10,15,20-tetraphenyl-21H,23H-porphine and 2,3,7,8,12,13,17,18-octaethyl-21H-23H-porphine and phthalocyanines. Such manganese compounds are known in the art and are known in the literature and some are commercially available.

Mn(III) species may also be provided in the etching composition chemically by using one or more Mn(II) compounds and one or more oxidizing agents. Oxidizing agents include, but are not limited to, $KMnO_4$, $MnO_2$, persulfates, such as alkali metal persulfates including ammonium and OXONE®, hydrogen peroxide or other inorganic peroxides, such as alkali, alkaline earth metal peroxides, organic peroxides, such as peroxycarbonic acids or hydroperoxides, chlorites such as alkali and alkaline earth metal chlorites, silver chlorite or lead chlorite, chlorates such as alkali and alkaline earth metal chlorates, perchlorates such as alkali and alkaline earth metal perchlorates including ammonium perchlorate, tetrabutylammonium perchlorate, silver perchlorate, copper perchlorate, nickel perchlorate, zinc perchlorate, cadmium perchlorate, lead perchlorate, mercury perchlorate or iron perchlorate and hypochlorites such as alkali and alkaline earth metal hypochlorites, osmiumtetroxide, silver(II)-oxide, ozone, cerium(IV) such as ammonium cerium(IV)-nitrate, cerium (IV)-oxide, cerium(IV)-sulfate, cerium(IV)-fluoride or ammonium cerium(IV)-sulfate dihydrate, and lead acetate. The amount of oxidizing agent or mixtures thereof added to the compositions are added in amounts below the stoichiometric amount of the Mn(II) compounds, such that the amount of the Mn(III) species generated is 0.01 mmol/L or greater and the Mn(II) species is 0.1 mmol/L or greater after the oxidizing agents have substantially all reacted.

Mn(III) species may also be generated from Mn(II) by electrolysis. One or more Mn(II) compounds are added to an aqueous solution including one or more acids. The electrolysis may be conducted in a one compartment cell or in a two compartment cell were anolyte and catholyte are separated by using a membrane or porous ceramic tube or plate. The anolyte includes one or more Mn(II) compounds and one or more acids and the catholyte includes one or more acids. Anodes and cathodes of various materials may be used, such as, but not limited to boron doped diamond (BDD), graphite, platinum, platinized titanium, lead, lead alloys, $PbO_2$, $IrO_2$ or mixed oxide anodes. Electrolysis is performed until a desired amount of Mn(III) species are produced to etch an organic polymer in preparation for subsequent metallization. Current densities may vary depending on the electrode materials and the rate of Mn(III) formation. Typically the current density is 0.1 $A/dm^2$ to 100 $A/dm^2$. When the Mn(III) species fall below the desired amount, electrolysis is started again until the desired amount of Mn(III) species in the etch composition is reached. Electrolysis reduces or eliminates the problem of having to replenish the etch composition baths during operation, such as in an industrial setting where time, efficiency and cost are important parameters to a given industry. Also installation costs for apparatus used in the electrolysis method are reduced.

Optionally one or more catalysts may be added to the compositions when applying the electrolysis method. One or more catalysts at concentrations from 0.01 mmol/L to 1 mmol/L may be used to increase the anodic current efficiency of the Mn(II)/Mn(III) oxidation reaction and increase the etching activity of the composition. Such catalysts include, but are not limited to, Ag(I), Bi(III), Ce(III) and Pb(II) ions. Sources of such catalytic ions are known in the art and literature and many are commercially available.

Acids included in the etching compositions may be organic or inorganic. Inorganic acids include, but are not limited to, sulfuric acid, peroxomonosulfuric acid, peroxodisulfuric acid, phosphoric acid, peroxomonophosphoric acid, peroxodiphosphoric acid, pyrophosphoric acid, hydrofluoric acid, tetrafluoroboric acid, hydrochloric acid, perchloric acid, nitric acid and mixtures thereof. Organic acids include, but are not limited to acetic acid, formic acid, alkyl sulfonic acids such as methane sulfonic acid, tartaric acid, citric acid, lactic acid, etylenediamine tetraacetic acid (EDTA), nitrilotriacetic acid (NTA) and mixtures thereof. A preferred acid is sulfuric acid. In general, acids are included in the compositions in amounts of at least 1M. When sulfuric acid is used, it is included in amounts of 7M to 16M.

The substrate with the organic polymer is immersed in the composition or the composition is sprayed on the substrate. Etching of the organic polymer is done at temperatures of 10° C. to 135° C., preferably from 20° C. to 100° C., more preferably from 30° C. to 80° C.

Organic polymers include, but are not limited to, thermosetting resins, thermoplastic resins, low $T_g$ resins, high $T_g$ resins and combinations thereof. Thermoplastic resins include, but are not limited to, acetal resins, acrylics, such as methyl acrylate, cellulosic resins, such as ethyl acetate, cellulose propionate, cellulose acetate butyrate and cellulose nitrate, polyethers, nylon, polyethylene, polypropylene, polystyrene, styrene blends, such as acrylonitrile styrene and copolymers and acrylonitrile-butadiene styrene (ABS) copolymers, polycarbonates (PC), polychlorotrifluoroethylene, and vinylpolymers and copolymers, such as vinyl acetate, vinyl alcohol, vinyl butyral, vinyl chloride, vinyl chloride-acetate copolymer, vinylidene chloride and vinyl formal.

Thermosetting resins include, but are not limited to, allyl phthalate, furane, melamine-formaldehyde, phenol-formaldehyde and phenol-furfural copolymers, alone or compounded with butadiene acrylonitrile copolymers or acrylonitrile-butadiene-styrene (ABS) copolymers, polyacrylic esters, silicones, urea formaldehydes, epoxy resins, allyl resins, glyceryl phthalates and polyesters.

The methods may also be used to etch both low and high $T_g$ resins. Low $T_g$ resins have a $T_g$ below 160° C. and high $T_g$ resins have a $T_g$ of 160° C. and above. Typically high $T_g$ resins have a $T_g$ of 160° C. to 280° C. High $T_g$ polymer resins include, but are not limited to, polytetrafluoroethylene (PTFE) and polytetrafluoroethylene blends. Such blends include, for example, PTFE with polyphenylene oxides and cyanate esters. Other classes of polymer resins which include resins with a high $T_g$ include, but are not limited to, epoxy resins, such as difunctional and multifunctional epoxy resins, bimaleimide/triazine and epoxy resins (BT epoxy), epoxy/polyphenylene oxide resins, acrylonitrile butadienestyrene, polycarbonates (PC), polyphenylene oxides (PPO), polypheneylene ethers (PPE), polyphenylene sulfides (PPS), polysulfones (PSU), polyamides (PA), polyesters such as polyethyleneterephthalate (PET) and polybutyleneterephthalate (PBT), polyetherketones (PEEK), liquid crystal polymers (LCP), polyurethanes (PU), polyetherimides (PEI), epoxies and composites thereof.

The substrate with the organic polymer is treated with the composition for 10 seconds to 30 minutes. After the organic polymers of the substrate are etched it is rinsed with water and then further processed using conventional methods in preparation for metallization. It is then metalized using conventional metal plating processes and metal plating baths, such as electroless nickel and electroless copper.

The following examples are included to further illustrate the invention but are not intended to limit its scope.

Example 1

Comparative

A stock solution of Mn(III) ions was prepared by dissolving 4.97 g $MnSO_4.H_2O$ (29.6 mmol) to 120 mL of water. 585 mL of 9.6M $H_2SO_4$ was added to yield 700 mL of a solution containing 29.6 mmol Mn(II) ions in 8M $H_2SO_4$ (Solution A). 1.162 g (7.3 mmol) $KMnO_4$ was dissolved in 35 mL of water to form an aqueous solution (Solution B). Solution B was added dropwise to solution A under stirring. Stirring was continued for another 2 hours at room temperature. During this time the $MnSO_4$ reacted according to equation 1 with $KMnO_4$ yielding a blood red solution of 50 mM Mn(III) ions in 7.6 M sulfuric acid.

An aliquot of 2 mL of Mn(III) ion stock solution and 35.3 mL of concentrated sulfuric acid (18M) was introduced in a 100 mL volumetric flask and topped with 14M sulfuric acid to make a 1 mmol/L solution of Mn(III) ions. The pH of the solution was less than 1. A 10 mL aliquot was taken from the 1 mM Mn(III) solution and placed in a quartz cuvette. The cuvette was then placed in a dual beam UV-VIS spectrometer (Hitachi U-2010 spectrometer) to measure its absorbance. The UV absorbance was scanned between 700 nm to 350 nm and the absorbance was measured from 520 nm to 525 nm. The absorbance spectrum of a 1 mM Mn(III) ion solution is shown in FIG. 1 by the dotted line.

An aqueous stock solution of 10 mmol (1.58 g) $KMnO_4$ was prepared by dissolving powdered $KMnO_4$ in one liter of de-ionized water to make a 10 mmol/L solution of Mn(VII) ions. A 10 mL aliquot was introduced into a 1 liter volumetric flask and topped with de-ionized water to make a 0.1 mmol/L solution of Mn(VII) ions. 10 mL of the 0.1 mmol/L solution was placed in a quartz cuvette and then placed in the UV-VIS spectrometer to measure its absorbance. The UV absorbance was scanned from 350 nm to 700 nm and the absorbance was measured from 450 nm to 600 nm. The solid line in FIG. 1 shows the absorbance spectrum of 0.1 mmol/L Mn(VII) ions. Although the peak maxima for each manganese species was within the same spectral range of 450 nm to 600 nm, the characteristic vibrational substructure of $MnO_4^-$ ion and the strong absorbance of Mn(III) ions at wavelengths of below 400 nm allowed for the two species to be distinguished.

Example 2

A stock solution was prepared by dissolving 10.1 g (60 mmol) $MnSO_4.H_2O$ in 160 ml $H_2O$. 795 mL of 9.6M $H_2SO_4$ was added to the $MnSO_4$ solution to yield 950 mL of a solution containing 60 mmol Mn(II) ions in 8M $H_2SO_4$ (Solution A).

1.58 g (10 mmol) $KMnO_4$ was dissolved in 52 mL $H_2O$ (Solution B). Solution B was then added dropwise to solution A under stirring. Stirring was continued for another 2 hours at room temperature. During this time substantially all of the $KMnO_4$ reacted with Mn(II) ions to yield a blood red solution of 50 mmol/L Mn(III) ions. The pH of the solution was less than 1. Since only 40 mmol of the 60 mmol Mn(II) ions were consumed in this reaction, this solution also contained 20 mmol/L Mn(II) ions, which is below its saturation point.

Figure 2:
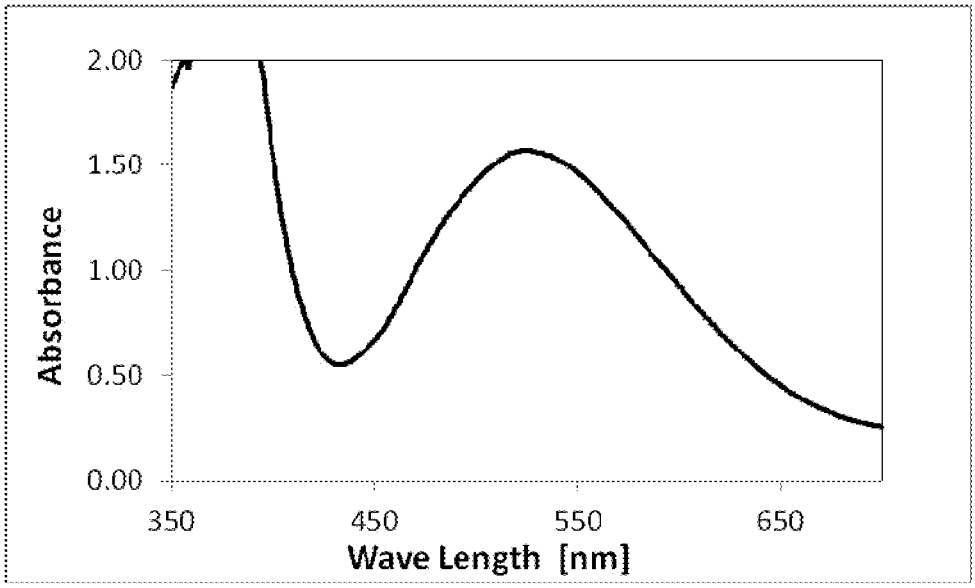
FIG. 2 is a UV-VIS spectrum as % absorbance vs. wave length in nm of a centrifuged etch composition containing 7.9 mM Mn(III) ions.

A suspension was prepared by mixing 440 mL of the stock solution with 600 mL 18M $H_2SO_4$ under continuous stirring yielding one liter containing 22 mmol Mn(III), dissolved and undissolved, and 8.8 mmol Mn(II), fully dissolved, in 14M $H_2SO_4$. The lower solubility of the Mn(III) compound at higher sulfuric acid concentrations resulted in a blue-violet precipitate of Mn(III)-sulfate forming with Mn(II) ions in solution. UV-VIS spectrum of the centrifuged suspension is shown in FIG. 2. The typical Mn(VII) peaks from 450 nm to 600 nm with four characteristic vibrational energy levels as shown in FIG. 1 were absent indicating that there was no Mn(VII) present in the suspension; however, the spectrum indicated that the Mn(III) species was clearly present. 7.9 mM of Mn(III) ions in the centrifuged solution was determined by the UV-VIS analysis.

An injection molded coupon of ABS/PC polymer (BAYBLEND™ T45PG) was immersed in the suspension for 12.5 minutes at 75° C. The coupon was then immersed in CONDUCTRON™ DP-H activator colloidal palladium solution (available from Dow Advanced Materials, Marlborough, Mass.) for 3 minutes at 30° C. The coupon was then rinsed with de-ionized water and immersed in a solution of ACCELERATOR™ PM-955 solution (available from Dow Advanced Materials) for 5 minutes at 45° C. The coupon was rinsed with de-ionized water and then immersed in NIPOSIT™ PM-980 electroless nickel plating solution (available from Dow Advanced Materials) for 10 minutes at 30° C. to form a conductive metal layer on the coupon. The nickel plated coupon was then rinsed with de-ionized water and plated at 1 $A/dm^2$ with a copper pyrophosphate bath at 40° C. followed by 40 minutes of plating at 4 $A/dm^2$ with COPPER GLEAM™ DL 900 bright copper deposit (available from Dow Advanced Materials) at room temperature. A bright copper layer was formed on the nickel layer. The coupon was then rinsed with tap water. The coupon showed complete coverage.

The adhesion of the metal layers to the coupon was then tested using the cross-hatch and tape test of ASTM D3359. When the test tape was applied then pulled from the metal plated coupon, no metal was observed on the tape indicating good adhesion between the plated metals and the etched coupon.

Example 3

Using an Ozone Generator LAB2B from Degremont Technologies ozone was passed through a suspension of 100 mM $MnSO_4.H_2O$ in 14M $H_2SO_4$ for 20 minutes at room temperature. During this time the colorless suspension turned dark violet indicating that Mn(III) ions formed. Analysis of total Mn(III) species using permanganometric back titration method (V. Pimienta et al *J. Phys. Chem.* 1994, 98, 13294-1329; and Analytical Chemistry: An Introduction, Saunders College Publishing, 1993, sixth Edition, ISBN: 0-03-097285-X, p312-318) as well as UV/VIS analysis of the centrifuged solution were then performed. The analysis indicated a total of 8 mM Mn(III) dissolved in solution. Therefore a total 92 mM Mn(II), dissolved and undissolved, remained. No Mn(VII) species was detected by the UV-VIS analysis. Afterwards the suspension was heated to 65° C. and an ABS polymer coupon (NOVODUR™ P2MC) was immersed for 10 minutes into the pickling suspension. Subsequent metallization using the process as described in Example 2 gave good metal coverage. The adhesion of the metal layers to the coupon was then tested using the cross-hatch and tape test of ASTM D3359. When the test tape was applied then pulled from the metal plated coupon, no metal was observed on the tape indicating good adhesion between the plated metals and the etched coupon.

Example 4

8 mM of Mn(III) as $Mn(CH_3COO)_3.H_2O$ (available from Sigma Aldrich®) was added to a suspension of 100 mM $MnSO_4.H_2O$ in 14M sulfuric acid under continuous stirring at room temperature. The suspension became blue-violet in color when the Mn(III) salt started to dissolve. After the Mn(III) salt was substantially all dissolved, the Mn(III) ion concentration was determined using the permanganometric back titration method. The concentration of the Mn(III) ions was determined to be 7.4 mM. The concentration was verified using the UV-VIS spectrum (Hitachi U2010 spectrometer) and comparing the absorbance value obtained from the spectrum against a calibration curve of known Mn(III) ion concentrations. There was no detectable Mn(VII) species on the UV-VIS spectrum.

An injection molded coupon of ABS polymer (NOVODUR™ P2MC) was measured for water drop contact angle using the conventional Kruss Easy Drop DSA 20. The contact angle of the water droplet measured 90° to the surface of the coupon indicating that the surface of the ABS coupon was hydrophobic. The coupon was then immersed in the suspension of Mn(II)-sulfate with Mn(II) ions and Mn(III) ions in solution for 10 minutes at 65° C. After the etching was completed the initially hydrophobic ABS surface became hydrophilic. This was shown by the contact angle measurement using the Kruss Easy Drop DSA 20 process. The contact angle of the water droplet to the surface of the etched ABS coupon was measured to be less than 30°, thus indicating that the etching of the coupon surface with the suspension of Mn(II) salt with dissolved Mn(II) ions and Mn(III) ions improved the wetting surface of the coupon.

Figure 3:
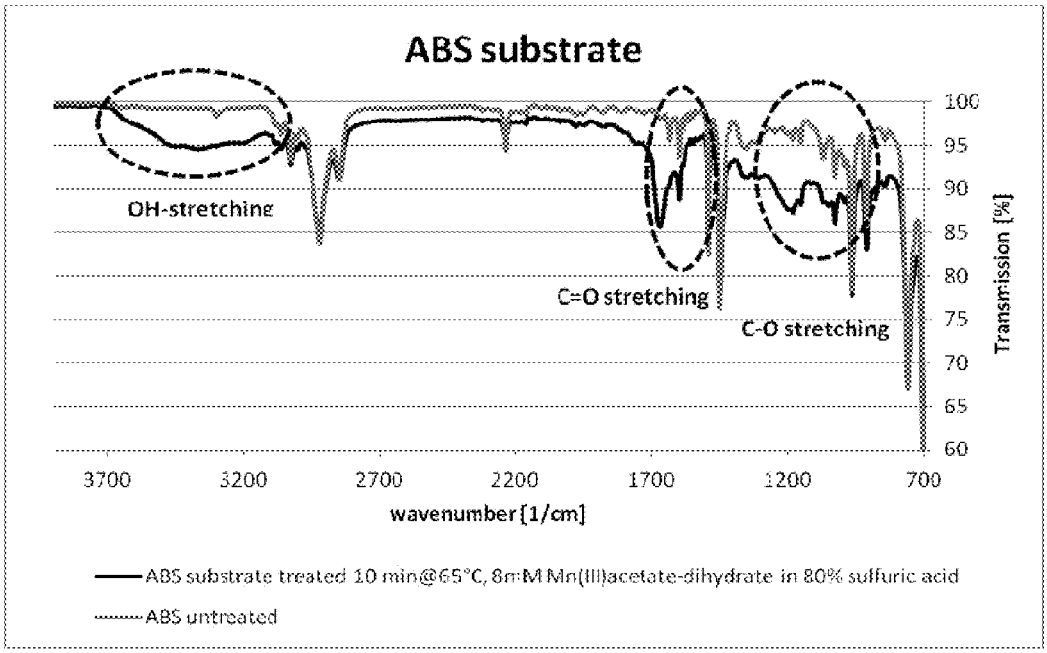
FIG. 3 is FT-IR-Spectra as % transmission vs. wave number in units of 1/cm of untreated ABS substrate vs. the ABS substrate 10 minutes after etching with a Mn(II) salt suspension containing Mn(II) ions and Mn(III) ions in solution at 65° C.

Further evidence of the etching performance of the suspension was shown by the FT-IR spectra (Thermo Scientific Nicolet iS10) of the surface of the ABS coupon before and after etching. The FT-IR spectrum of the surface of the ABS coupon prior to etching is shown in FIG. 3 by the light shaded curve. The FT-IR spectrum after etching as shown in FIG. 3 is indicated by the darker shaded curve. The characteristic stretching vibration peaks of hydroxyl (—OH), carbonyl (—C═O) and carboxyl (—COO) functional groups showed that these groups were formed on the surface during the etching process thereby increasing the hydrophilicity of the ABS substrate.

The etched ABS coupon was then plated with metal by using the process as described in Example 2. Good metal coverage was achieved. The adhesion of the metal layers to the coupon was then tested using the cross-hatch and tape test of ASTM D3359. When the test tape was applied then pulled from the metal plated coupon, no metal was observed on the tape indicating good adhesion between the plated metals and the etched coupon.

Example 5

An anode and a cathode made of platinum wire were placed in a conventional electrolytic plating cell containing a suspension of 100 mM $MnSO_4.H_2O$ and 0.25 mM $Ag_2SO_4$ in 14M $H_2SO_4$ at 60° C. This starting electrolyte was nearly colorless. The electrodes were connected to a conventional rectifier to provide a current source. When an anodic current density of 8 A/dm$^2$ was applied, the suspension turned from colorless to dark blue-violet indicating that Mn(III) ions were being generated. The current was switched off after the Mn(III) ion concentration reached 7 mM which is below the point where Mn(III) ions begin to precipitate out of solution as a salt at the given acid concentration and temperature. UV-VIS analysis revealed that no Mn(VII) was formed in the electrolyte. The UV-VIS spectrum curve was substantially the same shape as shown in FIG. 2 with a single absorbance peak within the range of 520-525 nm. The total Mn(II), dissolved and undissolved, was 93 mM determined by the difference between 100 mM of the total initial amount of Mn(II), dissolved and undissolved, and 7 mM of the Mn(III) ion concentration formed by the electrolysis.

An injection molded coupon of ABS/PC polymer blend (Bayblend™ T45PG) was immersed into the above suspension for 12.5 minutes at 75° C. The etched coupon was removed from the suspension and rinsed with water. It was plated with nickel and copper as described above in Example 2. Adhesion of the metal layers was also tested using the cross-hatch and tape test of ASTM D339. Good coverage and good adhesion between ABS/PC and the metal layers were observed.

Example 6

An anode made of platinum wire was placed in an aqueous solution containing 14M $H_2SO_4$, 200 mM $MnSO_4.H_2O$ and 0.25 mM $Ag_2O$ at 60° C. This starting solution was nearly colorless. A cathode made of platinum wire was placed in a separate compartment containing 14M $H_2SO_4$. The anode and the cathode compartments were separated by a porous ceramic tube allowing current to pass between the compartments. The anode and cathode were connected to a conventional rectifier to provide a current source. When current was applied with an anodic current density of 8 A/dm$^2$, the solution turned from colorless to dark blue-violet indicating that Mn(III) ions were being generated. The current was switched off after the total amount of Mn(III), dissolved and undissolved, as determined by permanganometric back titration, reached 90 mM which was above its saturation limit. The total concentration of Mn(II) was therefore 110 mM which was above the saturation limit of Mn(II). Accordingly, most of the Mn(II) and Mn(III) species were in salt form. The UV-VIS spectrum of the centrifuged suspension showed an absorbance curve having substantially the same shape and peak as shown in FIGS. 2 and 7.8 mM Mn(III) ions was determined to be in solution.

An injection molded coupon of ABS polymer was immersed into the above suspension for 15 minutes at 65° C. to etch the surface of the coupon. The pH of the suspension was less than 1. The etched coupon was then rinsed with de-ionized water and then plated by the process described in Example 2. Adhesion of the metal layers to the ABS coupon also was tested using the ASTM D339 cross-hatch and tape test. Good coverage and good adhesion between ABS and the metal layers were observed.

Example 7

An anode made of iridium oxide coated titanium was placed in an aqueous suspension containing 14M $H_2SO_4$, 100 mM $MnSO_4.H_2O$ and 5 mM bismuth oxide nitrate ($BiONO_3$) at 60° C. This starting electrolyte was nearly colorless. A cathode made of platinum wire was placed in a separate compartment containing 14M $H_2SO_4$. The anode and the cathode compartments were separated by a porous ceramic tube allowing the current to pass between each compartment. The anode and the cathode were connected to a rectifier to provide a source of current. When current was applied with an anodic current density of 0.5 A/dm$^2$, the suspension turned from colorless to dark blue-violet, indicating that Mn(III) ions were being generated. The current was switched off after the Mn(III) ion concentration reached 7.5 mM. UV-VIS analysis of the centrifuged suspension did not detect any Mn(VII) formed in the suspension. Mn(II) concentration was determined to be 92.5 mM which was above the saturation limit of Mn(II) salts. Accordingly, most of the Mn(II) species was present in the suspension as a salt.

An injection molded coupon of ABS polymer was immersed into the above suspension for 10 minutes at 65° C. The etched coupon was then rinsed with de-ionized water and then plated by the process described in Example 2. Adhesion of the metal layers to the ABS coupon was tested using the ASTM D339 cross-hatch and tape test. Good coverage and good adhesion between ABS and the metal layers were observed.

What is claimed is:

1. A method comprising:

a. providing a substrate comprising one or more organic polymers;

b. providing a composition comprising a suspension of one or more undissolved Mn(II) compounds, or one or more undissolved Mn(III) compounds, or mixtures thereof, dissolved Mn(II) ions and dissolved Mn(III) ions, and one or more acids; and c. contacting the substrate comprising the one or more organic polymers with the composition to etch a surface of the substrate.

2. The method of claim 1, wherein a total amount of Mn(II) are at a concentration of at least 0.1 mmol/L.

3. The method of claim 1, wherein a total amount of Mn(III) are at a concentration of at least 0.01 mmol/L.

4. The method of claim 1, wherein Mn(II) are oxidized to Mn(III) by electrolysis.

5. The method of claim 1, wherein Mn(II) are oxidized to Mn (III) by an oxidizing agent.

6. The method of claim 1, wherein a temperature of the composition ranges from 10° C. to 135° C.

7. The method of claim 1, wherein the substrate is contacted with the composition for 10 seconds to 30 minutes.

8. The method of claim 1, wherein the composition further comprises one or more catalysts.

9. The method of claim 8, wherein the catalyst is chosen from Ag(I), Bi(III), Ce(III) and Pb(II).

10. A composition comprising a suspension of one or more undissolved Mn(II) compounds, or one or more undissolved Mn(III) compounds, or mixtures thereof, dissolved Mn(II) ions and dissolved Mn(III) ions, and one or more acids.

* * * * *